US009455489B2

(12) United States Patent
Shiu et al.

(10) Patent No.: US 9,455,489 B2
(45) Date of Patent: Sep. 27, 2016

(54) CAVITY ANTENNAS

(75) Inventors: Boon W. Shiu, San Jose, CA (US); Peter Bevelacqua, Cupertino, CA (US); Jiang Zhu, Sunnyvale, CA (US); Jerzy Guterman, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 423 days.

(21) Appl. No.: 13/221,554

(22) Filed: Aug. 30, 2011

(65) Prior Publication Data

US 2013/0050032 A1 Feb. 28, 2013

(51) Int. Cl.

| | |
|---|---|
| ***H01Q 1/24*** | (2006.01) |
| ***H01Q 1/22*** | (2006.01) |
| ***H01Q 1/44*** | (2006.01) |
| ***H01Q 13/18*** | (2006.01) |

(52) U.S. Cl.

CPC ..... *H01Q 1/24* (2013.01); *H01Q 1/2258* (2013.01); *H01Q 1/44* (2013.01); *H01Q 13/18* (2013.01)

(58) Field of Classification Search

CPC ..... H01Q 1/24
USPC ..... 343/702
See application file for complete search history.

(56) References Cited

U.S. PATENT DOCUMENTS

| | | | | |
|---|---|---|---|---|
| 3,573,834 | A | 4/1971 | McCabe et al. | |
| 4,132,995 | A * | 1/1979 | Monser | H01Q 13/18 343/767 |
| 4,733,245 | A | 3/1988 | Mussler | |
| 5,461,393 | A | 10/1995 | Gordon | |
| 5,703,600 | A | 12/1997 | Burrell et al. | |
| 5,768,217 | A | 6/1998 | Sonoda et al. | |
| 5,872,557 | A | 2/1999 | Wiemer et al. | |
| 5,877,728 | A | 3/1999 | Wu et al. | |
| 5,914,693 | A | 6/1999 | Takei | |
| 5,936,583 | A | 8/1999 | Sekine et al. | |
| 6,081,729 | A | 6/2000 | Bauerschmidt et al. | |

(Continued)

FOREIGN PATENT DOCUMENTS

| | | | |
|---|---|---|---|
| CN | 1256802 | A | 6/2000 |
| CN | 1133237 | | 12/2003 |
| CN | 2850006 | Y | 12/2006 |
| CN | 101068056 | | 11/2007 |
| CN | 101276239 | | 10/2008 |
| EP | 0543645 | | 5/1993 |
| EP | 1329979 | A1 | 7/2003 |
| EP | 1329985 | A1 | 7/2003 |

(Continued)

OTHER PUBLICATIONS

Ayala Vazquez et al., U.S. Appl. No. 12/553,944, filed Sep. 3, 2009.
Guterman et al., U.S. Appl. No. 12/553,943, filed Sep. 3, 2009.
Ayala Vazquez et al., U.S. Appl. No. 12/486,496, filed Jun. 17, 2009.
Chiang et al., U.S. Appl. No. 12/500,570, filed Jul. 9, 2009.

(Continued)

*Primary Examiner* — Dameon E Levi
*Assistant Examiner* — Andrea Lindgren Baltzell
(74) *Attorney, Agent, or Firm* — Treyz Law Group, P.C.; G. Victor Treyz; Michael H. Lyons

(57) ABSTRACT

Cavity antennas may be provided for electronic devices. A cavity antenna may have a conductive antenna cavity with an opening. An antenna resonating element may be soldered within the cavity opening. An electronic device may have a display that is covered by a display cover layer. A cavity antenna may be mounted so that the cavity opening is located under a portion of the display cover layer outside of the active display region. An antenna cavity for a cavity antenna may have one or more bends. A curved antenna cavity or a cavity antenna with one or more angled branches may have a portion that extends between a conductive housing wall and internal device components such as a display. A speaker may be formed using the interior volume within a cavity antenna.

18 Claims, 18 Drawing Sheets

(56) References Cited

U.S. PATENT DOCUMENTS

| | | | | |
|---|---|---|---|---|
| 6,127,987 | A | 10/2000 | Maruyama et al. | |
| 6,225,959 | B1 | 5/2001 | Gordon | |
| 6,339,400 | B1 | 1/2002 | Flint et al. | |
| 6,344,825 | B1 | 2/2002 | Wong | |
| 6,380,930 | B1 | 4/2002 | Van Ruymbeke | |
| 6,621,466 | B2 | 9/2003 | Kuck | |
| 6,642,892 | B2 | 11/2003 | Masaki et al. | |
| 6,646,605 | B2 | 11/2003 | McKinzie et al. | |
| 6,677,909 | B2 | 1/2004 | Sun et al. | |
| 6,831,607 | B2 | 12/2004 | Hebron et al. | |
| 6,859,186 | B2 | 2/2005 | Lizalek et al. | |
| 6,861,995 | B2 | 3/2005 | Kuo et al. | |
| 6,894,650 | B2 | 5/2005 | Darden et al. | |
| 6,985,361 | B2 | 1/2006 | Credelle et al. | |
| 7,075,782 | B2 | 7/2006 | Teshima | |
| 7,126,553 | B1 | 10/2006 | Fink et al. | |
| 7,199,756 | B2 | 4/2007 | Cha et al. | |
| 7,233,678 | B2 | 6/2007 | Erixon et al. | |
| 7,256,743 | B2 | 8/2007 | Korva | |
| 7,322,833 | B1 | 1/2008 | Hakansson et al. | |
| 7,342,539 | B2 | 3/2008 | Rosenberg et al. | |
| 7,345,634 | B2 | 3/2008 | Ozkar et al. | |
| 7,405,704 | B1 | 7/2008 | Lin et al. | |
| 7,446,729 | B2 | 11/2008 | Maruyama et al. | |
| 7,463,121 | B2 | 12/2008 | D'Ostilio | |
| 7,486,242 | B2 | 2/2009 | Gala Gala et al. | |
| 7,579,993 | B2 | 8/2009 | Lev et al. | |
| 7,629,930 | B2 | 12/2009 | Murch et al. | |
| 7,688,276 | B2 | 3/2010 | Quintero Illera et al. | |
| 7,710,331 | B2 | 5/2010 | Schillmeier et al. | |
| 7,804,453 | B2 | 9/2010 | Chiang et al. | |
| 8,054,232 | B2 | 11/2011 | Chiang et al. | |
| 8,059,039 | B2 | 11/2011 | Ayala Vazquez et al. | |
| 8,102,319 | B2 | 1/2012 | Schlub et al. | |
| 8,269,677 | B2 | 9/2012 | Guterman et al. | |
| 8,638,549 | B2 | 1/2014 | Garelli et al. | |
| 8,766,858 | B2 | 7/2014 | Li et al. | |
| 8,773,310 | B2 | 7/2014 | Shiu et al. | |
| 2002/0149523 | A1 | 10/2002 | Fang et al. | |
| 2002/0171594 | A1 | 11/2002 | Fang | |
| 2003/0001780 | A1 | 1/2003 | Hill et al. | |
| 2003/0090426 | A1 | 5/2003 | Sun et al. | |
| 2003/0197648 | A1 | 10/2003 | Quinn et al. | |
| 2004/0051670 | A1 | 3/2004 | Sato | |
| 2004/0075611 | A1 | 4/2004 | Kenoun et al. | |
| 2004/0097270 | A1 | 5/2004 | Cha et al. | |
| 2004/0108960 | A1 | 6/2004 | Huo et al. | |
| 2005/0017914 | A1 | 1/2005 | Huang | |
| 2005/0200535 | A1 | 9/2005 | Elkobi et al. | |
| 2006/0164315 | A1 | 7/2006 | Munk | |
| 2006/0227053 | A1 | 10/2006 | Ishikura | |
| 2006/0244663 | A1 | 11/2006 | Fleck et al. | |
| 2007/0057855 | A1 | 3/2007 | Mizoguchi et al. | |
| 2007/0115187 | A1 | 5/2007 | Zhang et al. | |
| 2007/0120740 | A1 | 5/2007 | Iellici et al. | |
| 2007/0176846 | A1 | 8/2007 | Vazquez et al. | |
| 2007/0202933 | A1 | 8/2007 | Tolbert et al. | |
| 2007/0216594 | A1 | 9/2007 | Uno et al. | |
| 2007/0262090 | A1 | 11/2007 | Ritsche | |
| 2007/0296592 | A1 | 12/2007 | Huang et al. | |
| 2008/0018551 | A1 | 1/2008 | Cheng et al. | |
| 2008/0316117 | A1 | 12/2008 | Hill et al. | |
| 2009/0067141 | A1 | 3/2009 | Dabov et al. | |
| 2009/0115683 | A1 | 5/2009 | Kurashima et al. | |
| 2009/0133825 | A1 | 5/2009 | Prat et al. | |
| 2009/0153412 | A1* | 6/2009 | Chiang | H01Q 1/52 343/702 |
| 2009/0174612 | A1 | 7/2009 | Ayala et al. | |
| 2009/0262029 | A1 | 10/2009 | Chiang et al. | |
| 2009/0265969 | A1 | 10/2009 | Nezu | |
| 2009/0295648 | A1 | 12/2009 | Dorsey et al. | |
| 2009/0315788 | A1 | 12/2009 | Hirota | |
| 2010/0060529 | A1 | 3/2010 | Schlub et al. | |
| 2010/0073241 | A1* | 3/2010 | Ayala Vazquez | H01Q 1/2266 343/702 |
| 2010/0123632 | A1 | 5/2010 | Hill et al. | |
| 2010/0156741 | A1 | 6/2010 | Vazquez et al. | |
| 2010/0182205 | A1* | 7/2010 | Chiang | H01Q 9/30 343/702 |
| 2010/0231481 | A1* | 9/2010 | Chiang | H01Q 1/243 343/898 |
| 2010/0321249 | A1 | 12/2010 | Chiang et al. | |
| 2010/0321253 | A1 | 12/2010 | Ayala Vazquez et al. | |
| 2010/0321325 | A1 | 12/2010 | Springer et al. | |
| 2011/0006953 | A1 | 1/2011 | Chiang et al. | |
| 2011/0025575 | A1 | 2/2011 | Niederkorn et al. | |
| 2011/0050508 | A1 | 3/2011 | Guterman et al. | |
| 2011/0050509 | A1* | 3/2011 | Ayala Vazquez | H01Q 1/2266 343/702 |
| 2011/0111719 | A1* | 5/2011 | Man | H01Q 1/243 455/269 |
| 2011/0175790 | A1 | 7/2011 | Yanagi et al. | |
| 2011/0188179 | A1 | 8/2011 | Myers et al. | |
| 2011/0241943 | A1 | 10/2011 | Shiu et al. | |
| 2011/0241948 | A1 | 10/2011 | Bevelacqua et al. | |
| 2011/0254745 | A1 | 10/2011 | Tsujimura et al. | |
| 2012/0026048 | A1 | 2/2012 | Vazquez et al. | |
| 2012/0068893 | A1 | 3/2012 | Guterman et al. | |
| 2012/0127040 | A1 | 5/2012 | Tang et al. | |
| 2012/0218695 | A1 | 8/2012 | Sakai | |
| 2012/0223865 | A1 | 9/2012 | Li et al. | |
| 2012/0223866 | A1 | 9/2012 | Ayala Vazquez et al. | |
| 2012/0280876 | A1 | 11/2012 | Qu | |
| 2013/0057367 | A1 | 3/2013 | Smith | |
| 2013/0293424 | A1 | 11/2013 | Zhu et al. | |
| 2013/0328730 | A1 | 12/2013 | Guterman et al. | |
| 2014/0085161 | A1 | 3/2014 | Zhu et al. | |
| 2014/0184453 | A1 | 7/2014 | Chen et al. | |
| 2014/0292591 | A1 | 10/2014 | Li et al. | |

FOREIGN PATENT DOCUMENTS

| | | |
|---|---|---|
| EP | 1868263 | 12/2007 |
| EP | 1950834 | 7/2008 |
| EP | 2034556 | 3/2009 |
| EP | 2110882 | 10/2009 |
| EP | 2128924 | 12/2009 |
| EP | 1483880 | 1/2010 |
| EP | 2495806 | 9/2012 |
| GB | 2437838 | 11/2007 |
| GB | 2485688 | 5/2012 |
| JP | HEI 09-083233 | 3/1997 |
| JP | 2003280815 | 10/2003 |
| JP | 2006048166 | 2/2006 |
| JP | 2007266822 | 10/2007 |
| JP | 2008306552 | 12/2008 |
| JP | 200935523 | 2/2009 |
| JP | 200965388 | 3/2009 |
| JP | 2009118027 | 5/2009 |
| JP | 2009290270 | 12/2009 |
| JP | 201010822 | 1/2010 |
| KR | 10-2004-0044211 | 5/2004 |
| KR | 10-2007-0016731 | 2/2007 |
| KR | 10-2010-0062539 | 6/2010 |
| TW | 201004024 | 1/2010 |
| WO | 9913526 | 3/1999 |
| WO | 99/36988 | 7/1999 |
| WO | 0215325 | 2/2002 |
| WO | 2007083500 | 7/2007 |
| WO | 2007135230 | 11/2007 |
| WO | 2012027024 | 3/2012 |

OTHER PUBLICATIONS

Chiang, U.S. Appl. No. 12/356,496, filed Jan. 20, 2009.
Zhu et al., U.S. Appl. No. 13/540,999, filed on Jul. 3, 2012.
Zhu et al., U.S. Appl. No. 13/629,061, filed on Sep. 27, 2012.
Chiang et al., U.S. Appl. No. 12/401,599, filed Mar. 10, 2009.
Shiu et al., U.S. Appl. No. 12/750,660, filed Mar. 30, 2010.
Bevelacqua et al., U.S. Appl. No. 12/750,661, filed Mar. 30, 2010.

* cited by examiner

CAVITY ANTENNAS

BACKGROUND

This relates generally to antennas and, more particularly, to cavity antennas for electronic devices.

Electronic devices often have wireless communications circuitry. For example, electronic devices may contain antennas and radio-frequency transceiver circuitry that is used in transmitting and receiving cellular telephone signals, wireless local area network signals, and other wireless traffic.

It may sometimes be desirable to mount an antenna resonating element within a conductive cavity to form a cavity-backed antenna ("cavity antenna"). This type of type of approach may be used, for example, when it is desired to isolate an antenna resonating element from its immediate surroundings within an electronic device. In a typical configuration, a cavity may have a rectangular box shape with a rectangular opening in which an antenna resonating element is formed.

The use of conventional cavity antenna designs can help provide antennas with good immunity from surrounding structures in an electronic device and can help reduce the impact of manufacturing variations on antenna performance. Conventional cavity antennas may, however, be challenging to manufacture and may be challenging to mount within devices where space is constrained such as devices with compact housings.

It would therefore be desirable to be able to provide improved cavity antennas.

SUMMARY

Cavity antennas may be provided for electronic devices. A cavity antenna may have a conductive antenna cavity with an opening. An antenna resonating element may be mounted within the opening. The antenna resonating element may implemented using a laser-patterned antenna resonating element, an antenna resonating element formed from a two-shot plastic substrate, an antenna resonating element formed from a printed circuit substrate, or other types of antenna resonating element structure. The antenna resonating element may be soldered within the cavity opening so that the conductive material of the resonating element is electrically shorted to the conductive material of the cavity along at least part of the edge of the cavity opening.

An electronic device may have a display that is covered by a cover glass layer. The display and other internal device components may be mounted in an electronic device housing.

A cavity antenna may be mounted so that its cavity opening and resonating element lie under a portion of the cover glass layer outside of the portion covering the display. The cavity antenna may have cavity wall portions that bend or otherwise extend between internal electronic device components and portions of the electronic device housing. Extended antenna cavities such as these have curves, branches that surround internal device components, T shapes, and other shapes that help maximize the volume of the cavity while accommodating internal components in a device and other cavity mounting constraints.

A speaker may be formed using the interior volume within a cavity antenna. Speaker components such as a speaker diaphragm and a speaker driver may be mounted within the interior volume of the cavity antenna.

Further features of the invention, its nature and various advantages will be more apparent from the accompanying drawings and the following detailed description of the preferred embodiments.

DETAILED DESCRIPTION

Figure 1:
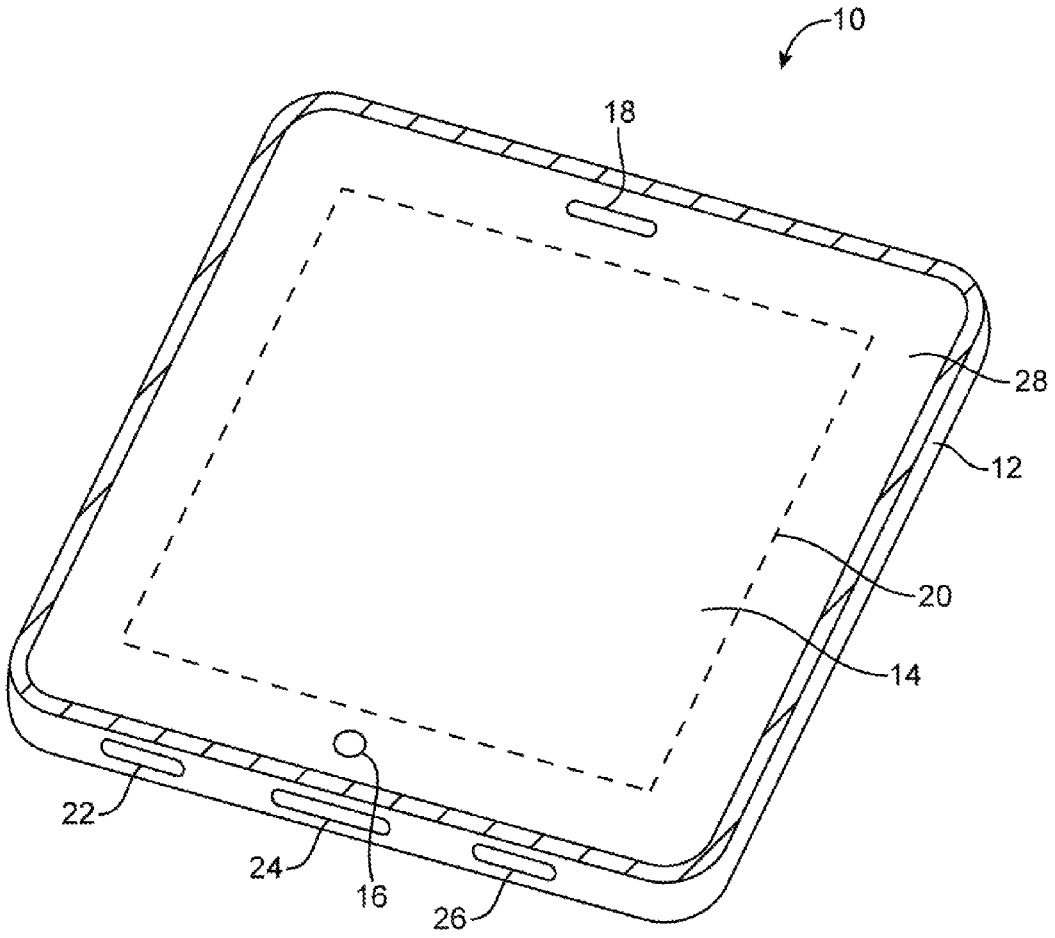
FIG. 1 is a perspective view of an illustrative electronic device of the type that may be provided with one or more cavity antennas in accordance with an embodiment of the present invention.

Electronic devices such as electronic device 10 of FIG. 1 may be provided with wireless communications circuitry. The wireless communications circuitry may be used to support wireless communications in cellular telephone bands, wireless local area network bands, and other wireless communications bands. The wireless communications circuitry may include one or more antennas. For example, one or more antennas may be used to handle cellular telephone bands, one or more antennas may be used to handle wireless local area network bands, and additional antennas may be used in handling additional communications bands of interest.

The antennas within device 10 may be based on inverted-F antenna resonating elements, planar inverted-F antenna resonating elements, open or closed slot antenna resonating elements, monopoles, dipoles, L-shaped antenna resonating elements, patch antenna resonating elements, loop antenna resonating elements, or any other suitable type of antenna resonating element. The antenna resonating elements may be mounted in conductive cavities to form cavity antennas (also sometimes referred to as cavity-backed antennas).

Device 10 of FIG. 1 may include one or more different types of cavity antenna. With one suitable arrangement, which is sometimes described herein as an example, device 10 may be provided with one or more antenna cavities that are bent along their length. The bent or otherwise non-uniform shape of this type of cavity antenna may be exploited to help mount the cavity antenna within the potentially compact confines of electronic device 10. If desired, a cavity antenna for device 10 may be formed using a cavity structure that serves both as an antenna cavity and as an internal speaker volume (sometimes referred to as a speaker box or speaker cavity). This type of arrangement may help conserve space within device 10. Cavity antennas may be formed from antenna resonating elements that are soldered onto a metal cavity structure or may be formed using other suitable arrangements.

Electronic device 10 of FIG. 1 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a cellular telephone, a media player, etc.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material. In other situations, housing 12 or at least some of the structures that make up housing 12 may be formed from metal elements. In a housing configuration with conductive structures, a cavity antenna may be configured to place a cavity opening and an associated antenna resonating element adjacent to dielectric structures (e.g., portions of a display, a dielectric antenna window, portions of dielectric housing, etc.). This type of arrangement may allow antenna signals to be transmitted and received through the dielectric structures. Other portions of the cavity antenna may be recessed within the interior of the electronic device housing.

Device 10 may, if desired, have a display such as display 14. Display 14 may, for example, be a touch screen that incorporates capacitive touch electrodes. Display 14 may include image pixels formed from light-emitting diodes (LEDs), organic LEDs (OLEDs), plasma cells, electronic ink elements, liquid crystal display (LCD) components, or other suitable image pixel structures. A cover glass layer may cover the surface of display 14. Portions of display 14 within rectangular region 20 may correspond to the active part of display 14. In active display region 20, an array of image pixels may be used to display images for a user. Portions of display 14 such as peripheral regions 28 surrounding rectangular active region 20 may be inactive and may be devoid of image pixel structures.

The cover glass layer that covers display 14 may have openings such as a circular opening for button 16 and a speaker port opening such as speaker port opening 18 (e.g., for an ear speaker for a user). Openings 16 and 18 may, for example, be formed in inactive portion 28 of display 14. Device 10 may also have other openings (e.g., openings in display 14 and/or housing 12 for accommodating volume buttons, ringer buttons, sleep buttons, and other buttons, openings for an audio jack, data port connectors, removable media slots, etc.). For example, the portion of housing 12 at the lower end of device 10 or other suitable portion of device 10 may have openings to form speaker port 22, connector port 24, and microphone port 26 (as an example).

Figure 2:
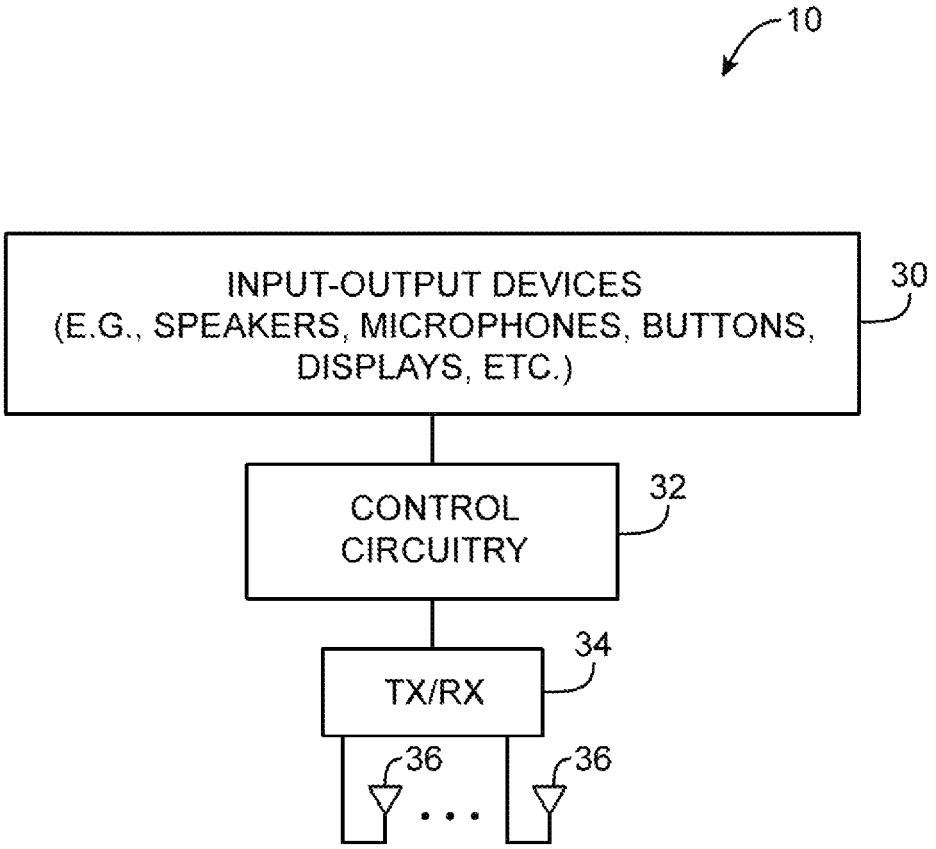
FIG. 2 is a schematic diagram of an illustrative electronic device showing how radio-frequency transceiver circuitry in the electronic device may be coupled to one or more antennas such as one or more cavity antennas in accordance with an embodiment of the present invention.

FIG. 2 is a diagram of illustrative components and circuitry that may be used in forming electronic device 10. As shown in FIG. 2, device 10 may have control circuitry 32. Control circuitry 32 may include processing circuitry such as one or more microprocessors, one or more microcontrollers, digital signal processors, application-specific integrated circuits, and other processing circuits. Control circuitry 32 may also have non-volatile and volatile storage (e.g., memory such as random-access memory, hard disk drives, solid state drives, etc.). The storage and processing circuitry of control circuitry 32 may be used to generate data that is to be wirelessly transmitted using radio-frequency transceiver circuitry 34 and, during signal reception operations, may be used to process incoming data that has been received by transceiver circuitry 34.

Transceiver circuitry 34 may include one or more radio-frequency transmitters and one or more radio-frequency receivers. During signal transmission operations, data that has been received from control circuitry 32 may be transmitted over one or more of antennas 36 using a transmitter in transceiver circuitry 34. During signal reception operations, data that has been transmitted to device 10 from an external source may be received by one or more of antennas 36 and radio-frequency receiver circuitry in transceiver 34.

Antennas 36 may include cavity antennas, non-cavity antennas, combinations of one or more cavity antennas and one or more non-cavity antennas, or other suitable antenna structures.

Control circuitry 32 may be coupled to electrical components such as input-output devices 30. Input-output devices 30 may include displays for displaying information to a user, sensors, keyboards, keypads, touch sensors (e.g., touch sensor arrays that are incorporated into displays), speakers, microphones, vibrators, light-emitting diodes (status indicator lights), input-output ports, and other circuitry and components for facilitating the process of providing a user with output and with gathering input from the user.

Figure 3:
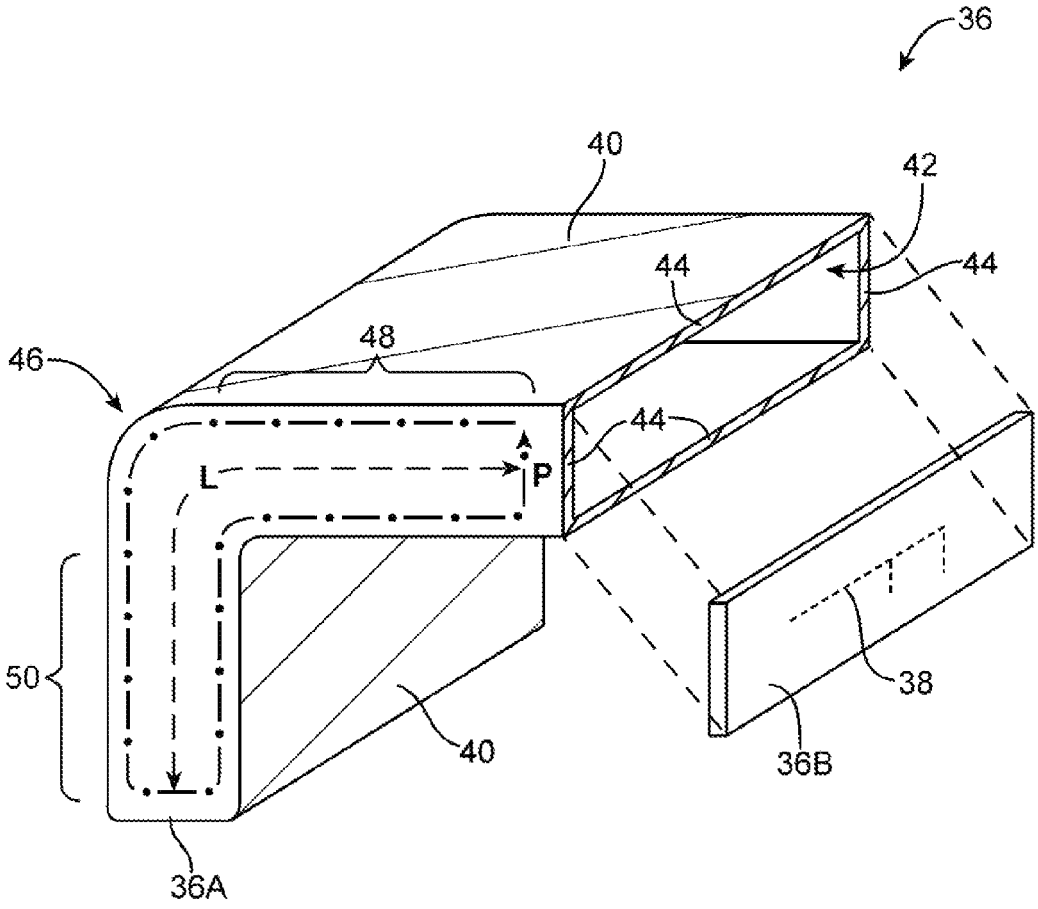
FIG. 3 is an exploded perspective view of an illustrative cavity antenna having a bent cavity shape in accordance with an embodiment of the present invention.

An illustrative cavity antenna is shown in FIG. 3. As shown in the exploded perspective view of FIG. 3, cavity antenna 36 may have a conductive cavity such as conductive cavity 36A and an antenna resonating element such as antenna resonating element 36B. Antenna resonating element 36B may be formed from conductive structures such as patterned conductive traces 38 on a dielectric substrate and may have any suitable configuration (e.g., an inverted-F configuration, a loop antenna configuration, a slot antenna configuration, etc.).

Cavity 36A may have conductive walls 40. Walls 40 may have edges 44 that surround an opening such as cavity opening 42. When assembled, antenna resonating element 36B may be mounted within opening 42 (e.g., on edges 44).

As shown in the example of FIG. 36A, cavity 36A may be shaped to facilitate mounting within electronic device housing 12. In particular, cavity walls 40 may be configured so that there is a bent (curved) portion such as bend 46 or other suitable curved portion along the length L of cavity 36A. Bend 46 separates straight portions 48 and 50 of cavity 36A from each other. Curved portion 46 in the FIG. 3 example forms a 90° bend, but other shapes for cavity 36B may be used if desired.

For optimal performance, it may be desirable to ensure that the volume of cavity 36B is not too small. Excessively small cavity volumes may decrease the bandwidth of antenna 36. With one suitable arrangement, length (depth) L of cavity 36B is not too small and perimeter P of cavity 36B is not too small. The dimensions of cavity 36B (e.g., length L, the lateral cavity dimensions perpendicular to L, perimeter P, etc.) are preferably at least one eighth of a wavelength at an operating frequency of interest and are preferably at least one quarter of a wavelength or one half of a wavelength or more. In some configurations, it may be desirable to form cavity walls 40 so that L is equal to about one quarter or one half of a wavelength at the operating frequency of antenna 36 (e.g., to help produce constructive interference). These are merely illustrative configurations that may be used for cavity 40. Any suitable cavity sizes and shapes may be used if desired.

Figure 4:
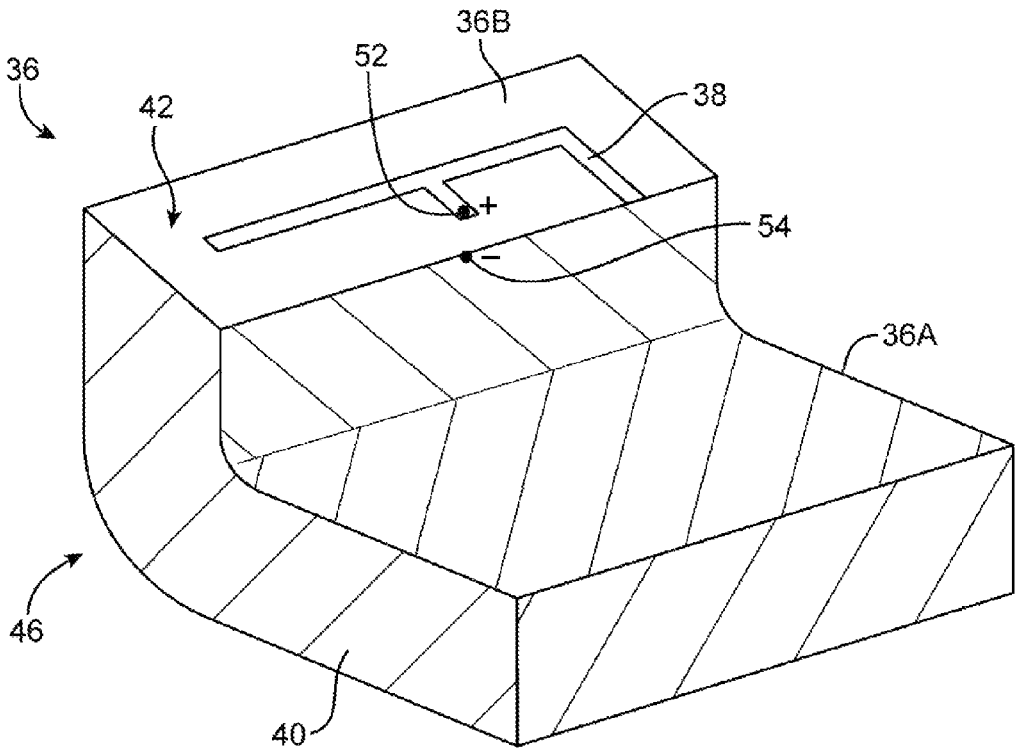
FIG. 4 is a perspective view of an illustrative cavity antenna with an inverted-F antenna resonating element in accordance with an embodiment of the present invention.

As shown in FIG. 4, antenna resonating element 36B in cavity antenna 36 may have an antenna feed formed from positive antenna feed terminal 52 and ground antenna feed terminal 54. Patterned antenna resonating element conductive structures such as illustrative trace 38 of FIG. 4 may be electrically connected to cavity 36A, which may serve as ground for antenna 36. The electrical connection between trace 38 and the cavity may be formed using solder or other electrically conductive materials and may be located along at least some of the edge of the cavity opening. With this type of configuration, ground antenna terminal 54 for the antenna feed for antenna resonating element 36B may be connected to a portion of antenna cavity 36A.

A transmission line may be coupled between the antenna feed for antenna resonating element 36B and transceiver circuitry 34 (FIG. 2). The transmission line may include structures such as microstrip transmission line structures, coaxial cable transmission line structures, etc. If desired, circuitry such as filters, impedance matching circuits, and other components may be interposed within the path between transceiver circuitry 34 and the feed for antenna resonating element 36. In the example of FIG. 4, conductive structures 38 in antenna resonating element 36B have the shape of an inverted-F antenna resonating element. This is merely illustrative. Antenna resonating element 36B may be formed using any suitable type of antenna resonating element structures.

Figure 5:
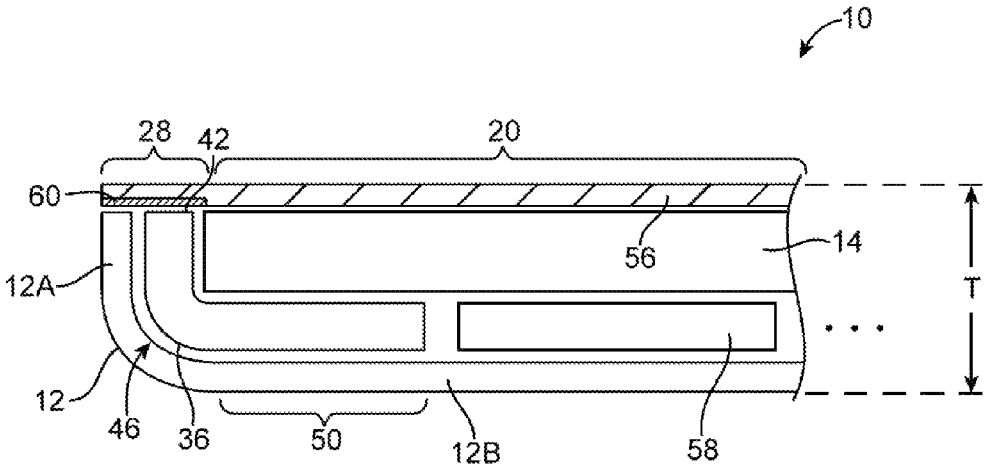
FIG. 5 is a cross-sectional side view of an illustrative cavity antenna with a bend that has been mounted within an electronic device in accordance with an embodiment of the present invention.

A cross-sectional side view of a portion of device 10 is shown in FIG. 5. As shown in FIG. 5, housing 12 of device 10 may have walls such as rear housing wall structure 12B and side housing wall structure 12A. In the example of FIG. 5, side wall 12A and rear wall 12B are substantially planar and lie in perpendicular planes. This is merely illustrative. Housing 12 may have a side wall that curves smoothly and forms an extension of a rear wall or may have other suitable housing shapes.

In the illustrative configuration of FIG. 5, device 10 has a display such as display 14. A cover layer such as cover layer 56 may be used in covering the surface (e.g., the front surface) of device 10. This helps protect the components of display 14. Cover layer 56 may be formed from a transparent material such as clear plastic, clear glass, or other suitable material and is sometimes referred to as display "cover glass." In active region 20 under cover glass 56, display 14 may actively display images for a user. In inactive region 28, the active structures of display 14 (display module 14) are not present. To help hide internal device structures from view, inactive region 28 (e.g., the interior surface of cover layer 56) may be provided with an opaque masking layer such as opaque masking layer 60. Opaque masking layer 60 may be formed from black ink, opaque plastic, or other suitable material that prevents the interior of device 10 under masking layer 60 from being viewed from the exterior of device 10.

Cavity antenna 36 may be mounted within the interior of housing 12 and device 10 so that cavity opening 42 (and the antenna resonating element that lies within cavity opening 42) is not blocked by conductive structures in display 14 and/or housing 12. With the illustrative configuration of FIG. 5, opening 42 has been mounted under cover glass 56 within inactive display region 28. During operation, radio-frequency signals for antenna 36 may pass through opaque masking layer 60 and the portion of cover glass 56 in region 28. Because the sidewalls of cavity antenna 36 are conductive and serve as antenna ground structures, the performance of cavity antenna 36 will be relatively insensitive to manufacturing variations in the distance between antenna 36 and adjacent conductive structures such as conductive housing structures 12 (e.g., conductive housing walls in configurations where housing 12 is formed from metal), conductive structures in display 14, and conductive structures in other internal device components 58 (e.g., integrated circuits, housing frame structures, connectors, other internal device components, etc.). In the example of FIG. 5, cavity opening 42 has been mounted under a portion of cover layer 56. In general, cavity opening 42 may mounted under any desired dielectric structure in device 10.

As shown in FIG. 5, bend 46 allows the length and therefore the total volume of cavity antenna 36 to be enlarged without being constrained by the limited thickness of device housing 12 and device 10. In particular, bend 46 allows portion 50 of the antenna cavity to be extended under conductive internal device components such as the conductive structures associated with display 14, thereby enlarging the size of cavity antenna 36 without undesirably increasing thickness T of device 10.

Figure 6:
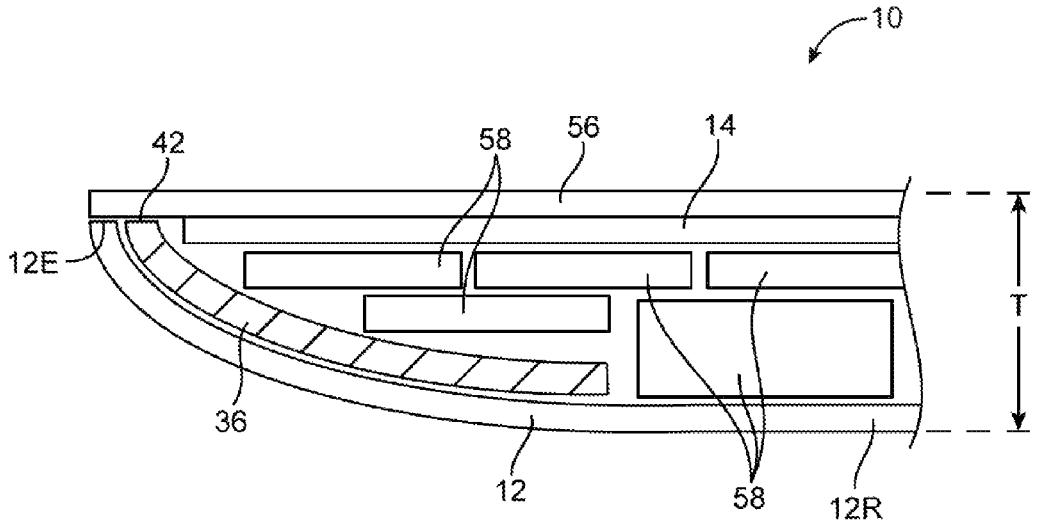
FIG. 6 is a cross-sectional side view of an illustrative cavity antenna with a curved shape that has been mounted within an electronic device in accordance with an embodiment of the present invention.

FIG. 6 is a cross-sectional side view of device 10 in a configuration in which housing 12 has curved walls extending from a front surface where edge 12E of housing wall 12 meets cover glass layer 56 to a rear planar surface 12R. Cavity antenna 36 may have a curved shape that allows the volume of the cavity antenna 36 to extend under and around internal device components such as display 14 and other internal components 58. This allows the volume of the cavity to be expanded without increasing the thickness T of device 10.

Figure 7:
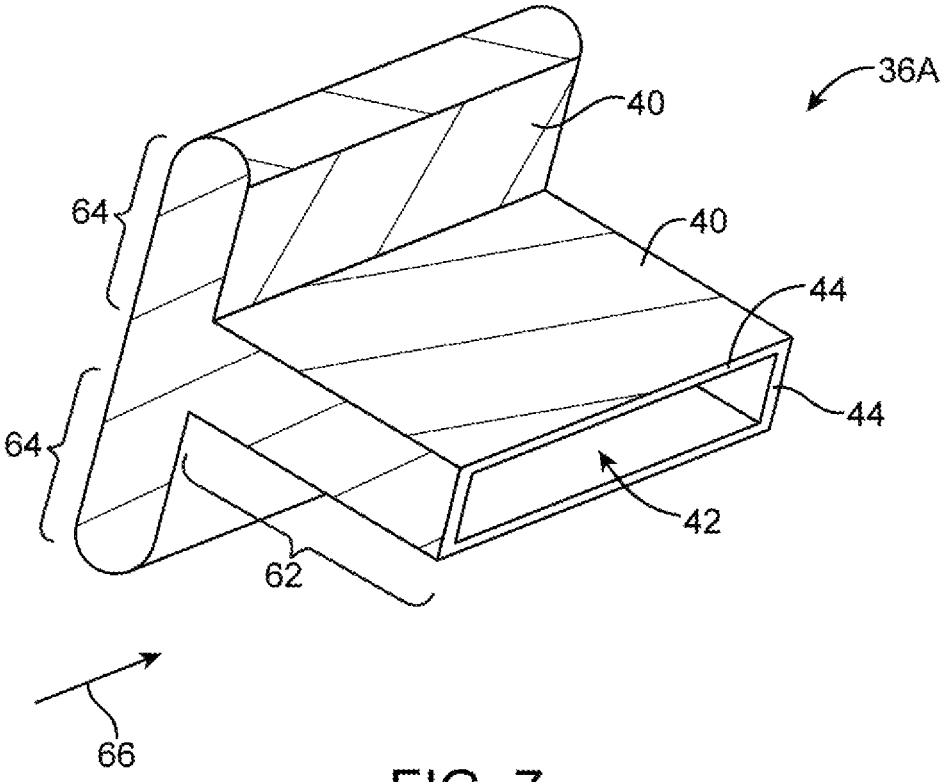
FIG. 7 is a perspective view of an illustrative T-shaped cavity for a cavity antenna in accordance with an embodiment of the present invention.

FIG. 7 is a perspective view of an illustrative antenna cavity having a T shape. As shown in FIG. 7, antenna cavity 36A may have a straight cavity portion such as portion 62. Opening 42 may be formed at one end of straight cavity portion 62. Opening 42 may have edges 44 in the shape of a rectangle or other suitable cavity opening shape. An antenna resonating element such as antenna resonating element 36B of FIG. 4 may be mounted within opening 42. Cavity 36A may have branching portions such as cavity extensions 64. Cavity portions 64 may, for example, be perpendicular to straight portion 62, so that the cavity 36A has a T shaped when viewed from side (end) direction 66.

Figure 8:
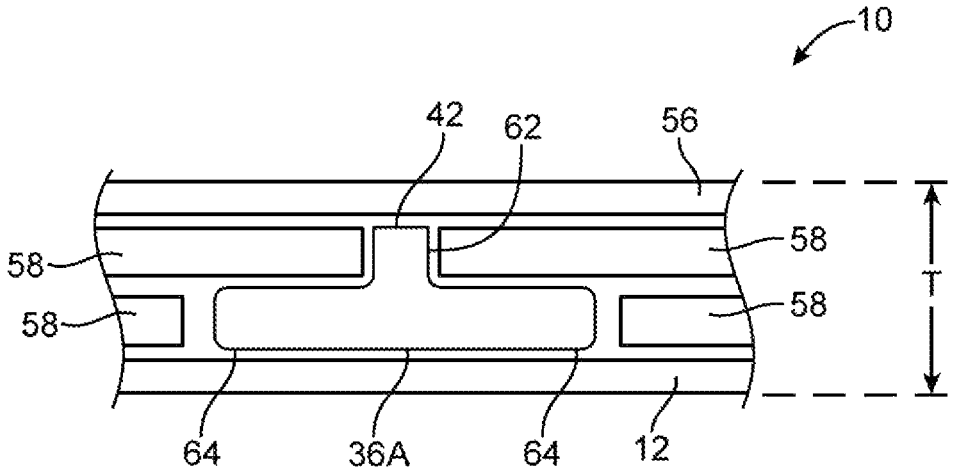
FIG. 8 is a cross-sectional side view of a cavity antenna having a T-shaped cavity of the type shown in FIG. 7 in a configuration in which the cavity antenna has been mounted within an electronic device in accordance with an embodiment of the present invention.

FIG. 8 is a cross-sectional side view of a portion of an electronic device having a T-shaped cavity antenna such as an antenna with a T-shaped cavity such as cavity 36A of FIG. 7. As shown in FIG. 8, cavity 36A may be oriented so that opening 42 (and the antenna resonating element 42 within opening 42) is mounted under a dielectric material such as cover layer 56 or a dielectric antenna window formed from a plastic structure of other dielectric structure that is mounted in an opening in conductive housing 12. Cavity extensions 64 may be used to expand the volume of cavity 36A without increasing thickness T of device 10. Extensions 64 may protrude under electrical components in the interior of device 10 such as components 58. With this type of arrangement, components such as components 58, other conductive internal device components such as display 14, and other conductive materials may be mounted between portions of cavity 36A and portions of cover glass 56 or other structures on the surface of device 10, thereby allowing cavity 36A to be mounted in devices with constrained layouts.

Figure 9:
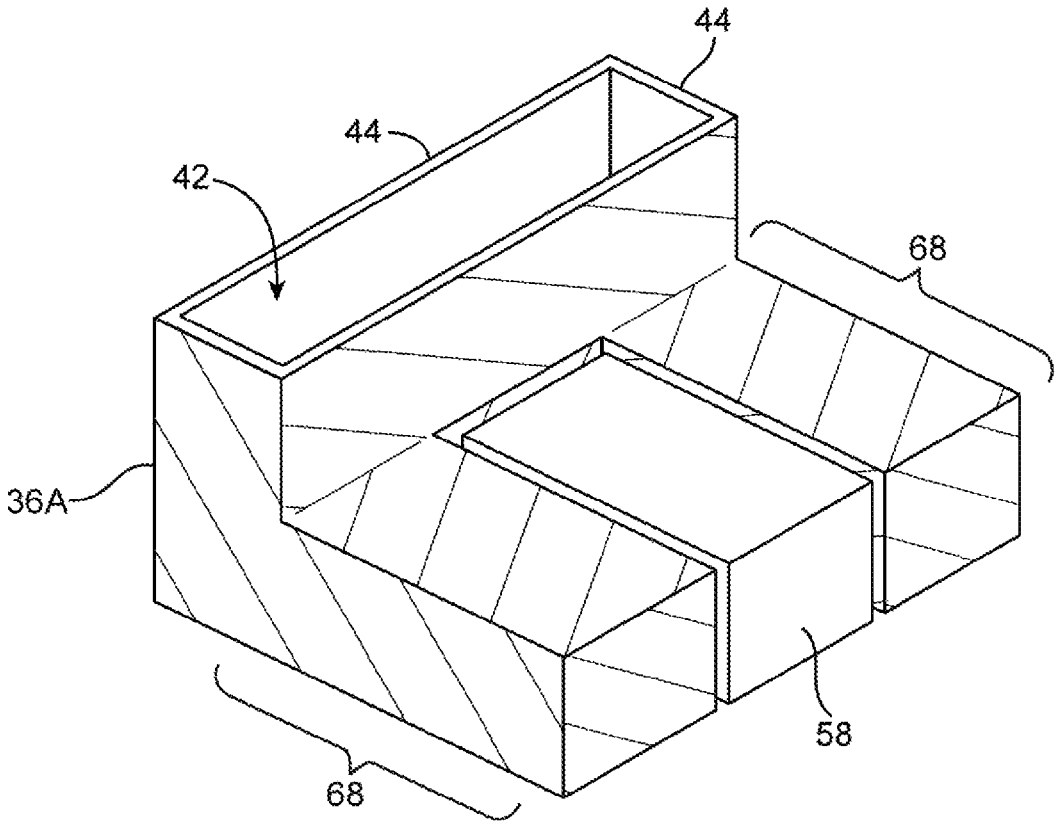
FIG. 9 is a perspective view of an illustrative cavity for a cavity antenna showing how the cavity may have a curved shape with a pair of cavity branches that extend past both sides of a device component in accordance with an embodiment of the present invention.

If desired, components 58 may be interposed within openings formed between respective portions of antenna cavity 36A. This type of configuration is shown in FIG. 9. As shown in FIG. 9, antenna cavity 36A may have first and second branches 68. Internal device components such as component 58 may be interposed between first and second branches 68. In configurations for cavity 36A in which portions 68 of cavity 36A surround conductive device components such as illustrative electrical device component 58 of FIG. 9, cavity volume may be maximized while accommodating desired component mounting locations.

Figure 10:
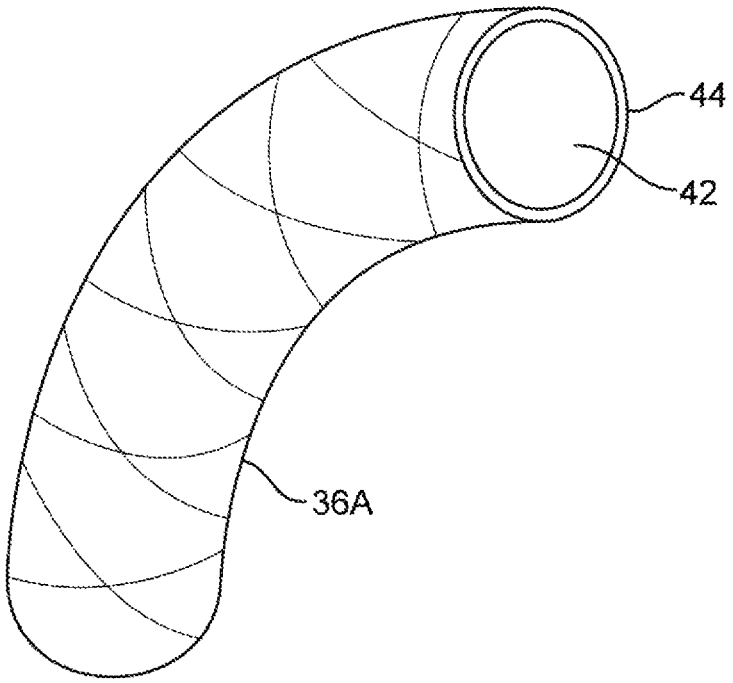
FIG. 10 is a perspective view of an illustrative tube-shaped cavity for a cavity antenna in accordance with an embodiment of the present invention.

Cavity 36A may have shapes with sides that are not planar. As shown in FIG. 10, for example, antenna cavity 36A may have a shape with curved sides such as a tube with one open end and one closed end. The sides of antenna cavity 36A may form a tubular shape with one branch (as shown in FIG. 10), a shape with multiple tubular branches, or other shapes with curved sides. If desired, cavity 36 may have a combination of curved and planar sides.

Figure 11:
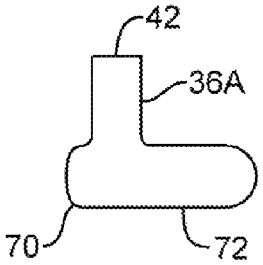
FIG. 11 is a side view of an illustrative cavity antenna with an asymmetric T shape in accordance with an embodiment of the present invention.

As shown in the cross-sectional side view of illustrative antenna cavity 36A of FIG. 11, antenna cavity 36A may have a T-shape with unequally sized branches. In the FIG. 11 example, branch 70 is shorter than branch 72.

Figure 12:
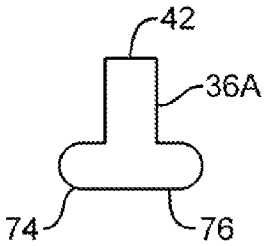
FIG. 12 is a side view of an illustrative cavity antenna with a symmetric T shape in accordance with an embodiment of the present invention.

The FIG. 12 example shows how T-shaped antenna cavity 36A may be formed using equally sized branches 74 and 76.

Figure 13:
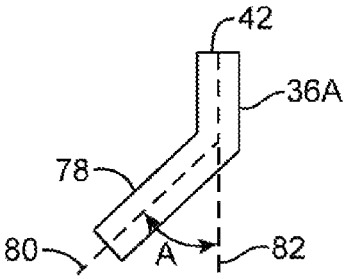
FIG. 13 is a side view of an illustrative cavity antenna with a bend in accordance with an embodiment of the present invention.

As shown in FIG. 13, antenna cavity 36A may have a bend so that portion 78 follows an axis (axis 80) that is oriented at a non-zero angle A with respect to main cavity axis 82.

Figure 14:
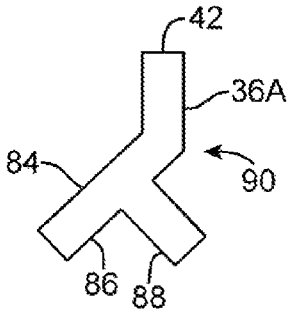
FIG. 14 is a side view of an illustrative cavity antenna with multiple bent branches in accordance with an embodiment of the present invention.
Figure 15:
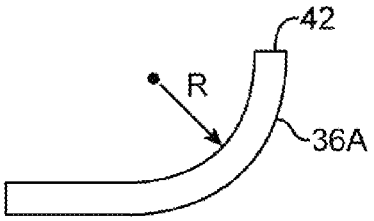
FIG. 15 a side view of an illustrative cavity antenna having a portion characterized by a bend radius in accordance with an embodiment of the present invention.

With the illustrative configuration for antenna cavity 36A that is shown in FIG. 14, bend 90 causes portion 84 to be angled with respect to the portion of cavity 36A that includes opening 42. Branches 86 and 88 may extend at different angles from portion 84.

Curved antenna cavity 36A may be characterized by bend radius R. To ensure that cavity 36A operates as a satisfactory antenna cavity, it may be desirable to configure the curved walls of antenna cavity 36A so that bend radius R is at least a quarter or a half of a wavelength at a desired operating frequency (as an example).

Figure 16:
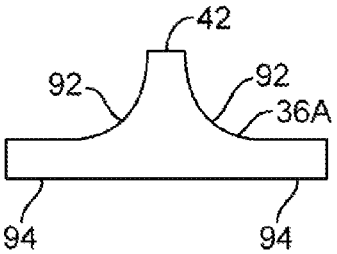
FIG. 16 is a side view of an illustrative cavity antenna with a pair of flared branches that form a T shape in accordance with an embodiment of the present invention.

As shown in FIG. 16, branches 92 of T-shaped antenna cavity 36A may have curved wall portions 92.

Figure 17:
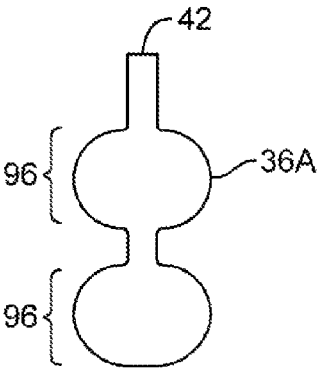
FIG. 17 is a side view of an illustrative cavity antenna having multiple chambers connected in series in accordance with an embodiment of the present invention.

FIG. 17 is a cross-sectional side view of an illustrative cavity having multiple chambers. In the configuration of FIG. 17, antenna cavity 36A has two chambers 96, which are coupled in series. Configurations with different numbers of chambers and chambers that branch off of a common cavity portion (e.g., parallel chambers) may also be used, if desired.

To conserve space within device 10 it may be desirable to form antenna cavity 36A using structures that serve multiple functions. For example, antenna cavity 36A may be formed, at least partly, using cavity structures that serve acoustic functions, structural functions, functions associated with forming connector ports, or other functions in device 10.

Figure 18:
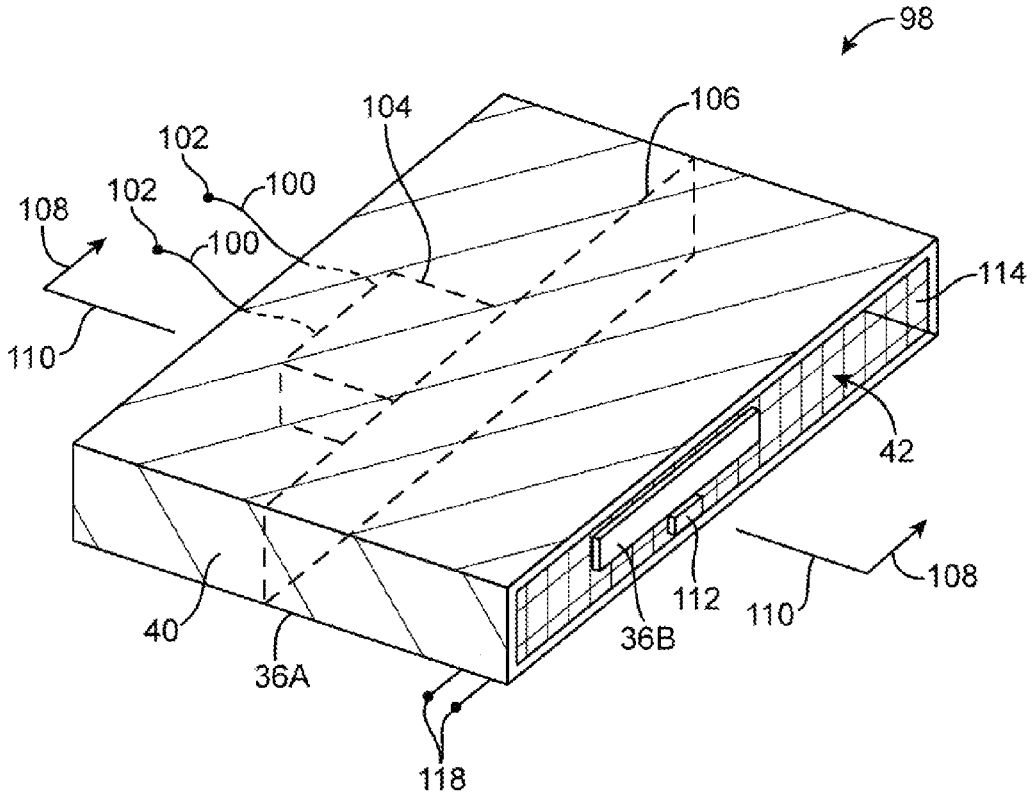
FIG. 18 is a perspective view of an illustrative speaker box that also serves as a cavity antenna in accordance with an embodiment of the present invention.

Antenna cavity 36A may, as an example, be implemented by forming conductive walls 40 on the sides of a chamber that is used in forming a speaker (i.e., a speaker box). This type of configuration is shown in FIG. 18. As shown in FIG. 18, structures 98 may have walls 40 that form a cavity structure for antenna cavity 36. Walls 40 may be formed from metal, from metal mounted on a support structure such as a plastic support structure, or other cavity structures. A speaker diaphragm such as diaphragm 106 may be mounted within the interior volume of cavity 36A. Speaker driver 104 may be provided with audio signals using paths 100 and terminals 102. An acoustically transparent cover such as mesh 114 may be placed over opening 42 in cavity 36A so that opening 42 serves as both a cavity antenna opening and a speaker port (opening) that allows sound to exit the interior volume of the speaker.

Antenna resonating element 36B may be mounted behind an acoustically transparent and radio-frequency transparent cover structure such as mesh 114 using a mounting structure such as mounting structure 112. Mounting structure 112 may be formed from plastic (e.g., an integral portion of the plastic that forms supporting structures for walls 40) or other materials. Resonating element 36B may have a smaller area than the area of opening 42, to allow sound that is produced by driving diaphragm 106 to exit the speaker. Antenna terminals 118 may be coupled to positive antenna feed and ground antenna feed terminals on antenna resonating element 36B. By combining both antenna cavity and speaker volume functions into structure 98, the overall size of device 10 can be minimized.

Figure 19:
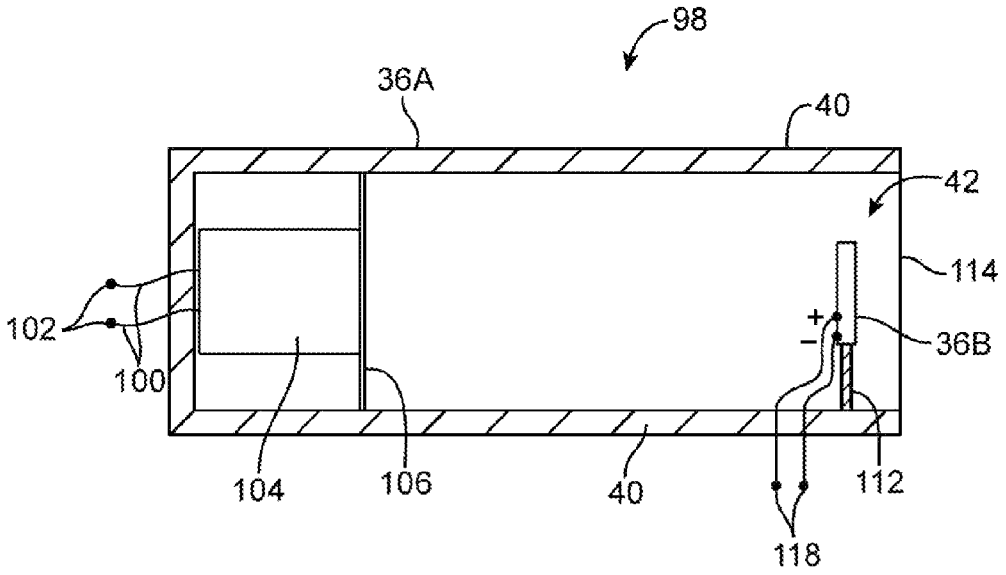
FIG. 19 is a cross-sectional side view of the illustrative speaker box cavity antenna of FIG. 18 in accordance with an embodiment of the present invention.

A cross-sectional side view of the combined speaker and antenna cavity structure of FIG. 18 taken along line 110 and viewed in direction 108 is shown in FIG. 19. As shown in FIG. 19, antenna resonating element 36B may be mounted within the interior of antenna cavity 36A in opening 42. Antenna resonating element 36B may, as an example, be mounted behind acoustic mesh 114. Structures that include both cavity antenna structures and speaker structures of the type shown in FIGS. 18 and 19 may be formed using any suitable cavity shape (see, e.g., cavity shapes of the type shown in FIGS. 11-17).

Figure 20:
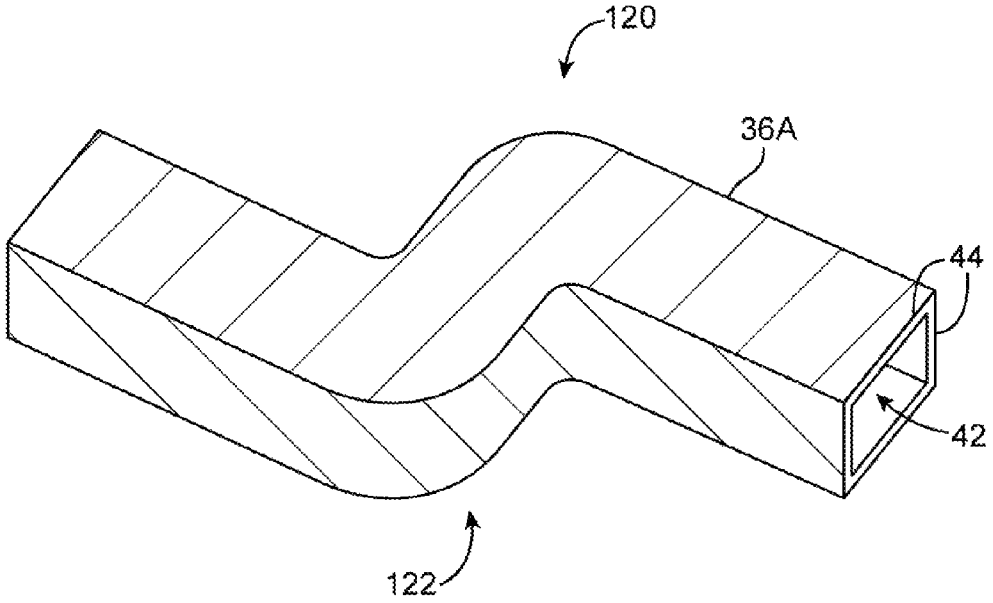
FIG. 20 is a perspective view of a cavity such as a speaker-box cavity having multiple consecutive bends in accordance with an embodiment of the present invention.
Figure 21:
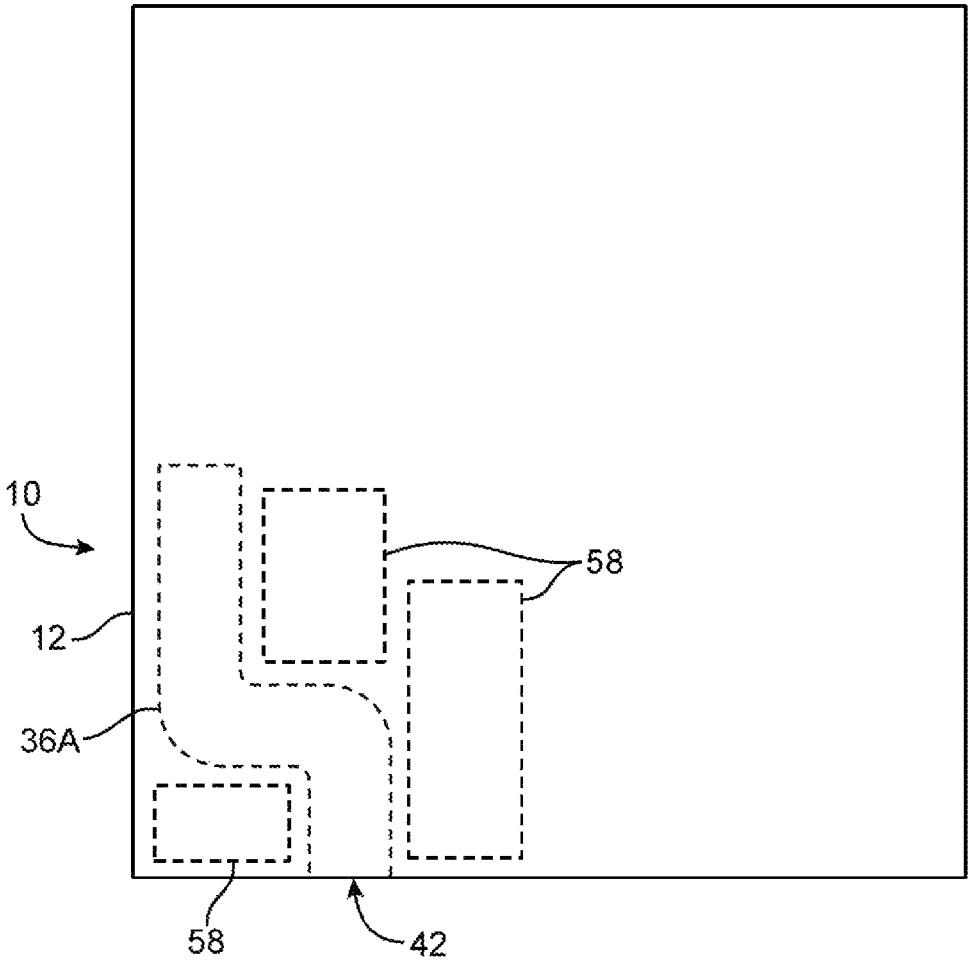
FIG. 21 is top view of an illustrative electronic device showing where a cavity antenna of the type shown in FIG. 20 may be mounted in accordance with an embodiment of the present invention.

As shown in the example of FIG. 20, cavity 36A (e.g., an antenna cavity or a chamber that serves both antenna cavity and speaker box functions) may have multiple bends along its length such as bends 120 and 122. FIG. 21 is a top view of device 10 showing how a cavity shape of the type shown in FIG. 20 may be used to allow cavity 36A to be routed past internal components 58 so that the volume of cavity 36A may be maximized. In the example of FIGS. 20 and 21, cavity 36A has a length with two bends. If desired, more than two bends may be formed along the length of cavity 36A or the length of cavity 36A may be provided with fewer bends or bends of different shapes.

Cavity walls such as cavity walls 40 of antenna cavity 36A may be formed from sheets of metal (e.g., stamped metal foil), from cast or machined metal, from patterned traces on printed circuit board substrates, using metal that is deposited onto a plastic carrier using electrochemical deposition or physical vapor deposition, using metal deposited on one or two shots of molded thermoplastic (e.g., a molded interconnect device) or any other suitable conductive materials. Techniques such as these may also be used in forming conductive structures for antenna resonating element 36B in cavity antenna 36.

With one suitable arrangement, laser patterning may be used in forming conductive antenna structures. Laser patterning processes may use thermoplastic materials that can be locally sensitized by exposure to laser light. Once sensitized, electroplating may be used to deposit additional metal and thereby form a desired pattern of conductive antenna structures. Laser patterning techniques of this type are sometimes referred to as Laser Direct Structuring (LDS). Tools for performing these techniques are available from LPFK Laser & Electronics AG of Garbsen, Germany.

Figure 22:
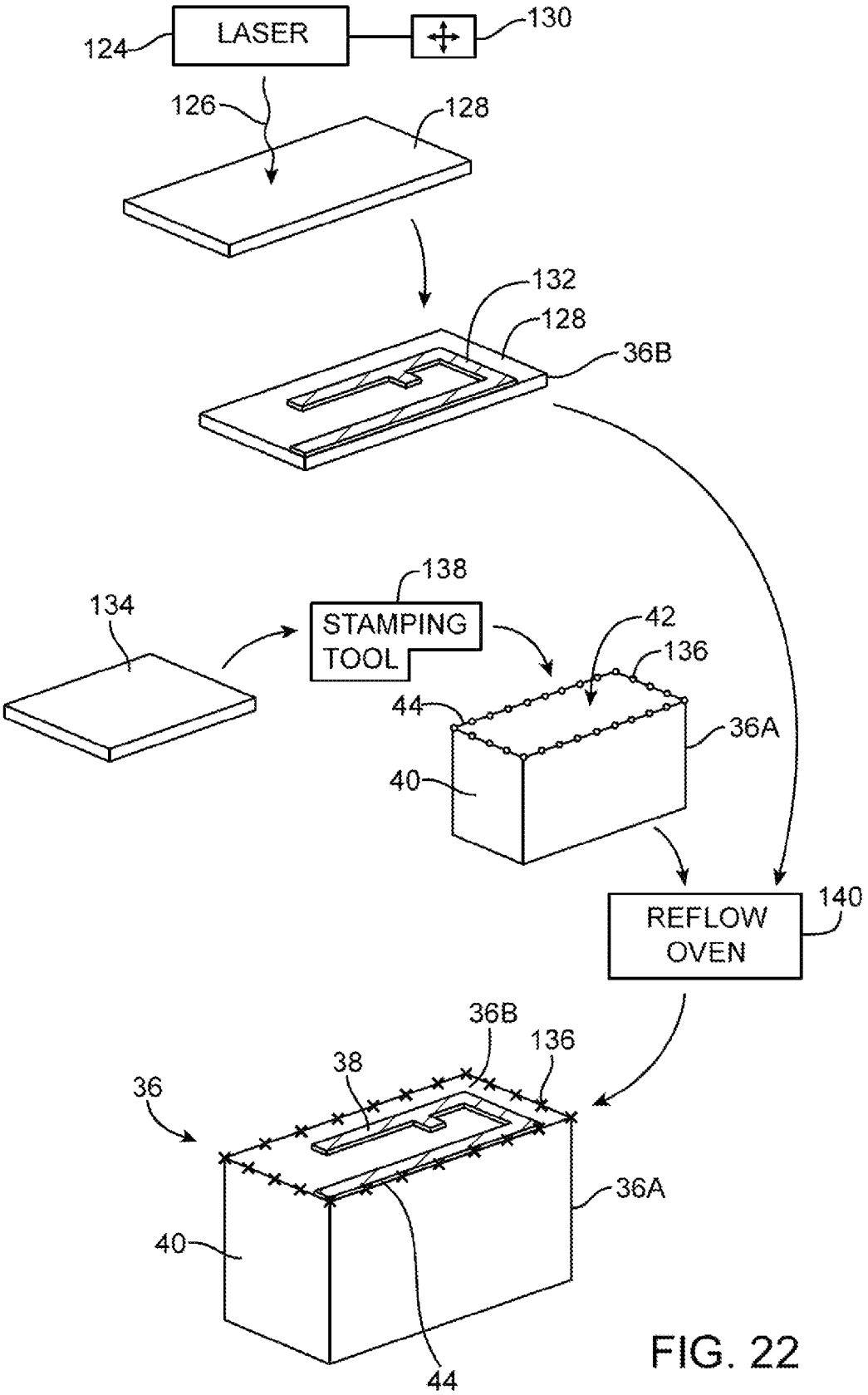
FIG. 22 is diagram showing how a laser-patterned antenna resonating element may be attached to a conductive cavity to form a cavity antenna in accordance with an embodiment of the present invention.

Use of an illustrative laser patterning technique in forming an antenna resonating element and subsequent steps involved in attaching the antenna resonating element to a conductive antenna cavity are shown in FIG. 22. As shown in FIG. 22, the relative position between laser 124 and substrate 128 may be controlled using one or more positioners such as positioner 130. Positioners such as positioner 130 may be implemented using computer-controlled translation stages or other computer-controlled actuators. Substrate 128 may be a dielectric substrate (e.g., a plastic substrate) with a composition that allows sensitization upon exposure to laser light).

After moving laser beam 126 over the surface of substrate 128, metal may be added to the sensitized portions of substrate 128 using electrochemical deposition (e.g., electroplating) to form antenna resonating element traces 132.

Conductive cavity walls 40 for antenna cavity 36A may be formed by using stamping tool 138 to form a conductive material such metal sheet 134 into a desired cavity shape or other techniques may be used in forming conductive cavity walls 40. Solder 136 (e.g., a bead of solder paste) may be formed around the periphery of opening 42 in cavity 36A (i.e., on some or all of edges 44). After placing antenna resonating element 36B in opening 42, antenna 36 may be placed in solder reflow oven 140 or may otherwise be exposed to heat (e.g., from a heat gun, laser, etc.). The heat may cause the solder paste to reflow and form solder joints 136 around some or all of the edges of antenna resonating element 36B (e.g., portions of the edge of cavity opening 42 where the conductive material of the antenna resonating element is present). As shown in the lower portion of FIG. 22, solder 136 may connect conductive structures 38 on antenna resonating element 36B around peripheral portions of cavity opening 42 (i.e., along at least some of peripheral edge 44) to the conductive material of cavity walls 40 of cavity 36A. Structures 38 may, in general, extend around some or all of the periphery of antenna resonating element 36B. Conductive adhesive, non-conductive adhesive, welds, screws, and other mechanical and/or electrical attachment techniques may also be used in connecting conductive structures in opening 42 such as antenna resonating element 36B to antenna cavity 36A in addition to or instead of using solder.

Figure 23:
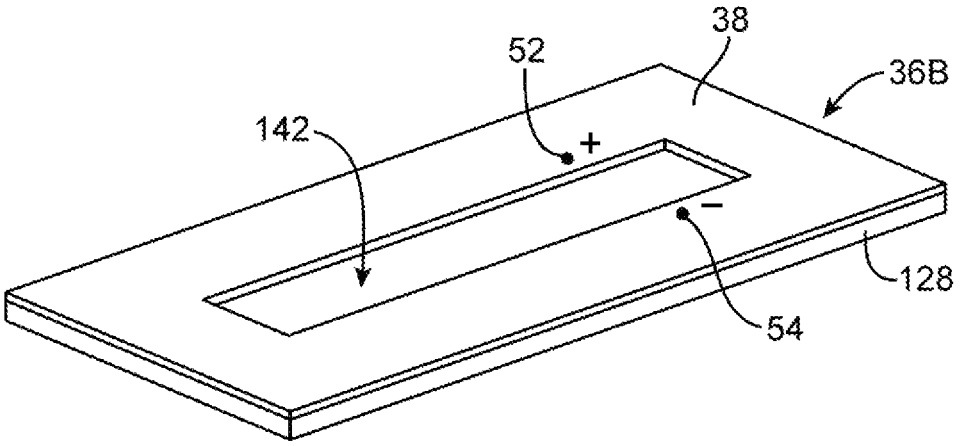
FIG. 23 is a perspective view of a slot antenna resonating element of the type that may be used in a cavity antenna in accordance with an embodiment of the present invention.

Antenna resonating element 36B may have an inverted-F shape, a planar inverted-F shape, a closed or open slot antenna shape, a loop antenna shape, an L-shape or T-shape, a horn antenna shape, or any other suitable antenna shape. FIG. 23 is a perspective view of an illustrative antenna resonating element shape in which antenna resonating element 36B has been formed from conductive antenna traces 38 that form a slot antenna shape with an opening (slot 142) on substrate 128. The slot antenna configuration for antenna resonating element 36B of FIG. 23 is merely illustrative. Antenna resonating elements for cavity-backed antenna 36 may have any suitable configuration.

Figure 24:
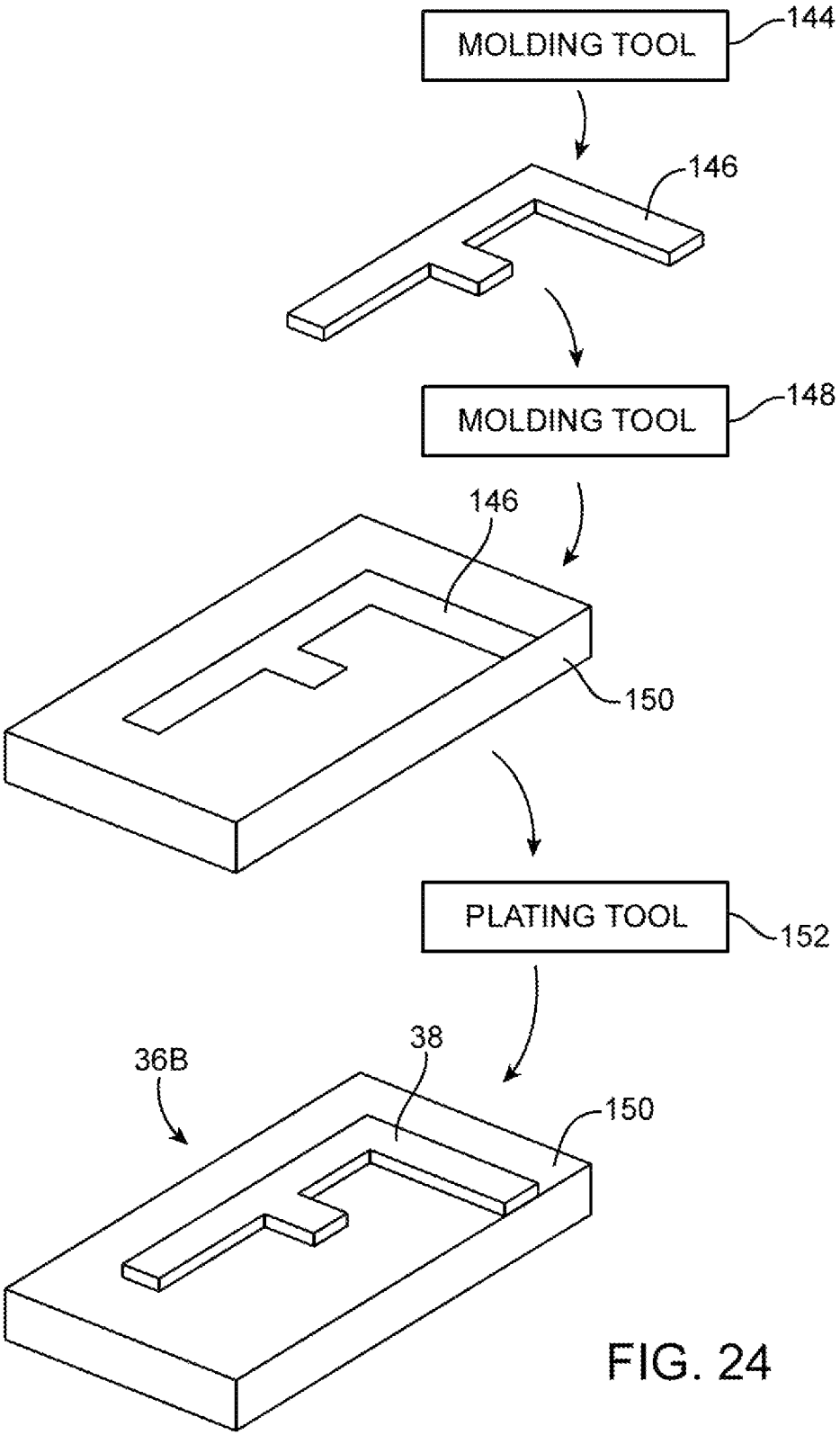
FIG. 24 is diagram showing how an antenna resonating element for a cavity antenna may be formed using a two-shot molding process and electroplating in accordance with an embodiment of the present invention.

FIG. 24 shows how a substrate for antenna resonating element 36B may be formed using a two-shot molding technique. With this type of arrangement, first substrate portion 146 may be formed using a first thermoplastic molding process implemented using molding tool 144. A second substrate portion such as portion 150 may then be molded to the first portion using molding tool 148. Portion 146 may have an affinity for metal deposition during exposure to electrochemical deposition processes (e.g., during electroplating), whereas portion 150 may be resistant to metal deposition. During metal plating operations using plating tool 152, metal will therefore be deposited in region 146 to form metal antenna traces 38 for antenna resonating element 36B, as shown in the lower portion of FIG. 24.

Use of two different types of thermoplastic in a two step molding process of the type shown in FIG. 24 is sometimes referred to as a "two-shot" molding process. Portion 146 may be referred to as a first shot of plastic and portion 150 may be referred to as a second shot of plastic. The resulting substrate that is formed may be referred to as a two-shot plastic substrate. Because the first and second shots of material have different metal deposition affinities, metal tends to build up selectively during electroplating, allowing the formation of desired antenna resonating element trace patterns on antenna resonating element 36B. Antenna resonating elements formed with traces that are deposited using two-shot molding and electroplating techniques or any other suitable selective metal deposition scheme may be soldered to antenna cavity 36B using soldering arrangements of the type shown in FIG. 22 or may be attached to antenna cavity 36B using other attachment mechanisms (conductive adhesive, welds, etc.), if desired.

The foregoing is merely illustrative of the principles of this invention and various modifications can be made by those skilled in the art without departing from the scope and spirit of the invention.

What is claimed is:

1. An electronic device, comprising:

a conductive housing having a rear wall;

a cavity antenna having an antenna cavity with conductive walls and an antenna resonating element, wherein the antenna cavity has an opening in which the antenna resonating element is located, the antenna cavity has curved portions that are located between the at least one conductive internal component and the conductive housing, the antenna cavity has a T-shape, and the antenna cavity comprises a first portion extending from the opening and first and second branching portions extending from opposing sides of the first portion;

a display cover layer;

a first electrical component within the conductive housing; and a second electrical component within the conductive housing, wherein the first electrical component is interposed between the display cover layer and the first branching portion, the second electrical component is interposed between the display cover layer and the second branching portion, the first portion is interposed between the display cover layer and the rear wall, the first portion is interposed between the first and second electrical components, the first branching portion is interposed between the first electrical component and the rear wall, and the second branching portion is interposed between the second electrical component and the rear wall.

2. The electronic device defined in claim 1 wherein the conductive housing comprises a metal housing wall.

3. The electronic device defined in claim 2 wherein the first electrical component comprises a display.

4. The electronic device defined in claim 3 wherein a region of the display cover layer covers the display and the opening is located adjacent to an area of the display cover layer outside of the region.

5. The electronic device defined in claim 4 wherein the antenna resonating element comprises a laser-patterned antenna resonating element that is soldered to an edge of the conductive walls of the antenna cavity, wherein the edge surrounds the opening.

6. The electronic device defined in claim 4 wherein the antenna resonating element comprises a two-shot plastic substrate.

7. The electronic device defined in claim 1 wherein the cavity antenna is configured to operate at an operating frequency, wherein the antenna cavity has a curved shape characterized by a bend radius, and wherein the bend radius is greater than one quarter of a wavelength at the operating frequency.

8. The electronic device defined in claim 7 further comprising a speaker having an interior chamber, wherein the conductive walls surround the interior chamber.

9. The electronic device defined in claim 8 wherein the speaker comprises a mesh covering the opening and the antenna resonating element.

10. Apparatus, comprising:

conductive cavity walls forming an antenna cavity in a cavity antenna and forming an interior volume for a speaker, wherein the antenna cavity has an opening that serves as a speaker port through which sound produced by the speaker exits the speaker, the conductive cavity walls defining a cross-sectional area of the antenna cavity;

a diaphragm; and a speaker driver attached to the diaphragm, wherein the diaphragm and the speaker driver are mounted within the antenna cavity and the diaphragm extends across an entirety of the cross-sectional area of the antenna cavity.

11. The apparatus defined in claim 10 wherein the antenna cavity has a length with at least two bends.

12. The apparatus defined in claim 10 wherein the antenna cavity comprises stamped metal walls and wherein the cavity antenna further comprises a laser-patterned antenna resonating element in the opening.

13. The apparatus defined in claim 12 wherein the opening has an edge and wherein the apparatus further comprises solder connected to the antenna resonating element along at least part of the edge.

14. An electronic device, comprising:

a conductive housing having a sidewall structure and a rear wall structure;

a display within the conductive housing, wherein the display comprises a display module and a display cover layer and the display module has a side surface and a rear surface; and a cavity antenna having an antenna cavity with conductive walls and an antenna resonating element, wherein the antenna cavity has a first portion interposed between the side surface of the display module and the sidewall structure of the conductive housing, a second portion interposed between the rear surface of the display module and the rear wall structure of the conductive housing, and a curved portion that extends between the first and second portions.

15. The electronic device defined in claim 14 wherein the cavity antenna is configured to operate at an operating frequency, wherein the curved portion is characterized by a bend radius, and wherein the bend radius is greater than one quarter of a wavelength at the operating frequency.

16. The electronic device defined in claim 1, wherein the first portion has first and second opposing ends, the first end is located adjacent to the opening, and the branching portions extend from the second end.

17. The electronic device defined in claim 16, wherein the first and second branching portions extend substantially perpendicular from the first portion.

18. The apparatus defined in claim 10, further comprising:

an audio line connected to the speaker driver that provides audio signals to the speaker driver, wherein the diaphragm is interposed between the speaker driver and the opening of the antenna cavity and the diaphragm is driven by the speaker driver;

an acoustically transparent cover member formed over the opening of the antenna cavity; and an antenna resonating element that is affixed to at least one of the cavity walls and that is interposed between the diaphragm and the acoustically transparent cover member.

* * * * *